US008890500B2

(12) United States Patent
Cheng

(10) Patent No.: US 8,890,500 B2
(45) **Date of Patent: *Nov. 18, 2014**

(54) POWER REGULATOR AND CONTROLLING METHOD THEREOF

(71) Applicant: Silergy Semiconductor Technology (Hangzhou) Ltd, Hangzhou (CN)

(72) Inventor: Shuai Cheng, Hangzhou (CN)

(73) Assignee: Silergy Semiconductor Technology (Hangzhou) Ltd, Hangzhou (CN)

( * ) Notice: Subject to any disclaimer, the term of this patent is extended or adjusted under 35 U.S.C. 154(b) by 140 days.

This patent is subject to a terminal disclaimer.

(21) Appl. No.: 13/709,453

(22) Filed: Dec. 10, 2012

(65) Prior Publication Data

US 2013/0093406 A1 Apr. 18, 2013

Related U.S. Application Data

(63) Continuation of application No. 12/932,183, filed on Feb. 18, 2011, now Pat. No. 8,384,362.

(30) Foreign Application Priority Data

Mar. 2, 2010 (CN) ..... 2010 1 0116178

(51) Int. Cl.
*G05F 1/00* (2006.01)
*G05F 1/10* (2006.01)

(52) U.S. Cl.
CPC ..... *G05F 1/10* (2013.01)
USPC ..... 323/283; 323/282; 323/288

(58) Field of Classification Search
USPC ..... 323/282, 283, 286, 288
See application file for complete search history.

(56) References Cited

U.S. PATENT DOCUMENTS

| | | | | |
|---|---|---|---|---|
| 7,482,793 | B2 * | 1/2009 | Stoichita | 323/282 |
| 7,714,547 | B2 * | 5/2010 | Fogg et al. | 323/224 |
| 8,169,205 | B2 | 5/2012 | Chen et al. | |
| 8,395,367 | B2 * | 3/2013 | Chien et al. | 323/288 |
| 8,446,136 | B2 * | 5/2013 | Schindler | 323/282 |

* cited by examiner

*Primary Examiner* — Emily P Pham
(74) *Attorney, Agent, or Firm* — Michael C. Stephens, Jr.

(57) ABSTRACT

Methods and circuits related to power regulation are disclosed. In one embodiment, a power regulator for converting an input electrical signal to an output electrical signal to supply power to a load, can include: (i) a power stage having switching devices and a filter; (ii) a regulation signal generator for the switching devices that includes a feedback circuit and a PWM, the feedback circuit receiving an output signal from the power stage, the PWM receiving an output from the feedback circuit, and generating a PWM control signal; (iii) a constant time generator receiving the PWM control signal and generating a constant time signal based on the PWM control signal duty cycle; and (iv) a logic/driving circuit receiving the PWM control signal and the constant time signal, and controlling operation of the switching devices to modulate the output signal from the power stage, and maintaining a pseudo constant operation frequency.

16 Claims, 9 Drawing Sheets

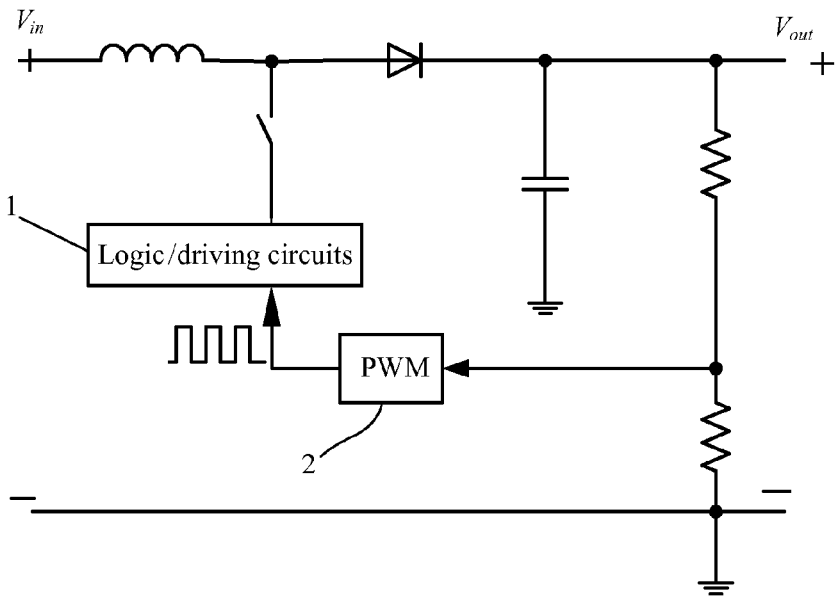
FIG. 1A (conventional)
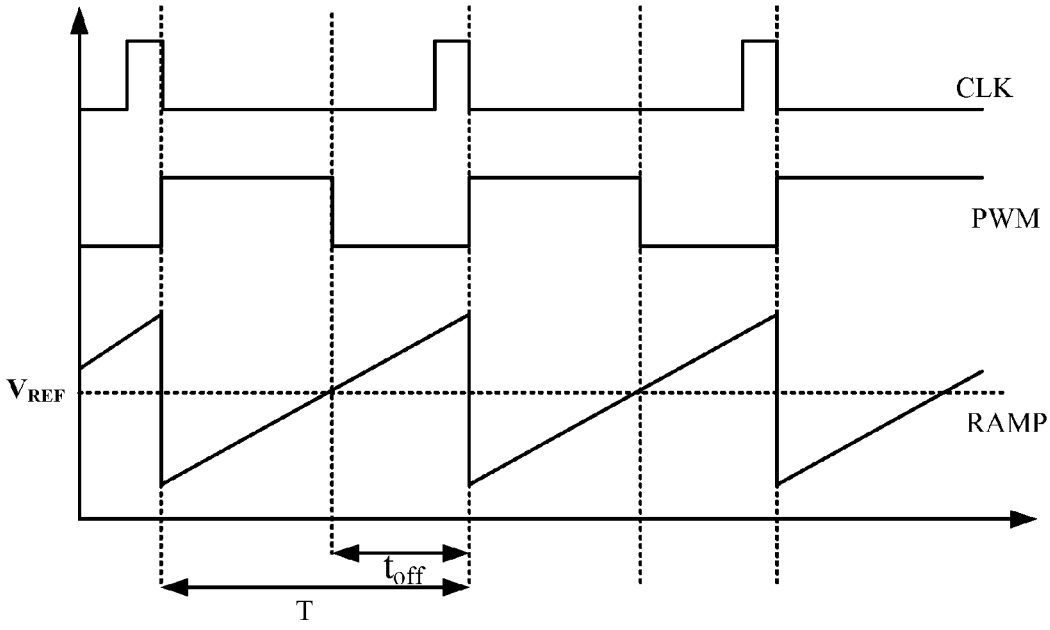
FIG. 1B (conventional)

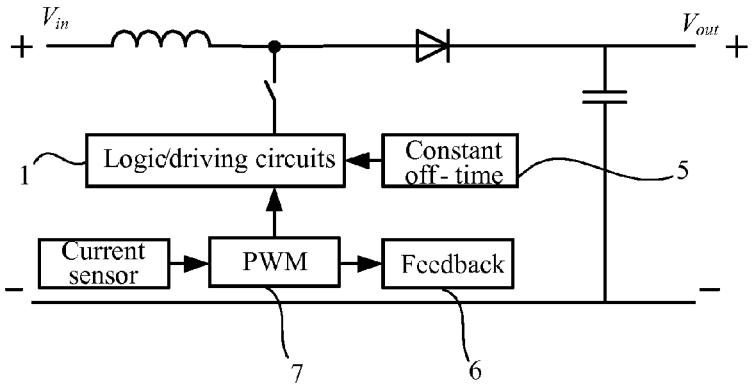
FIG. 2A (conventional)
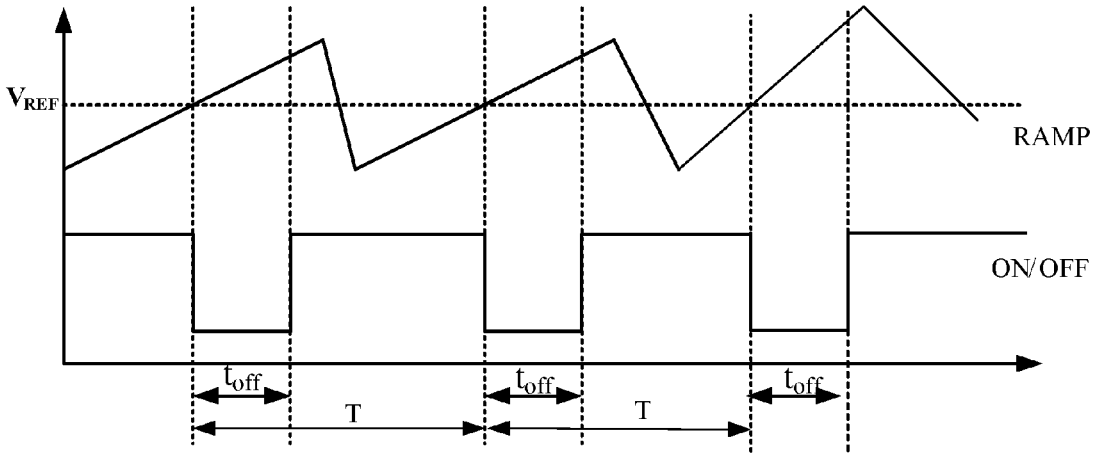
FIG. 2B (conventional)

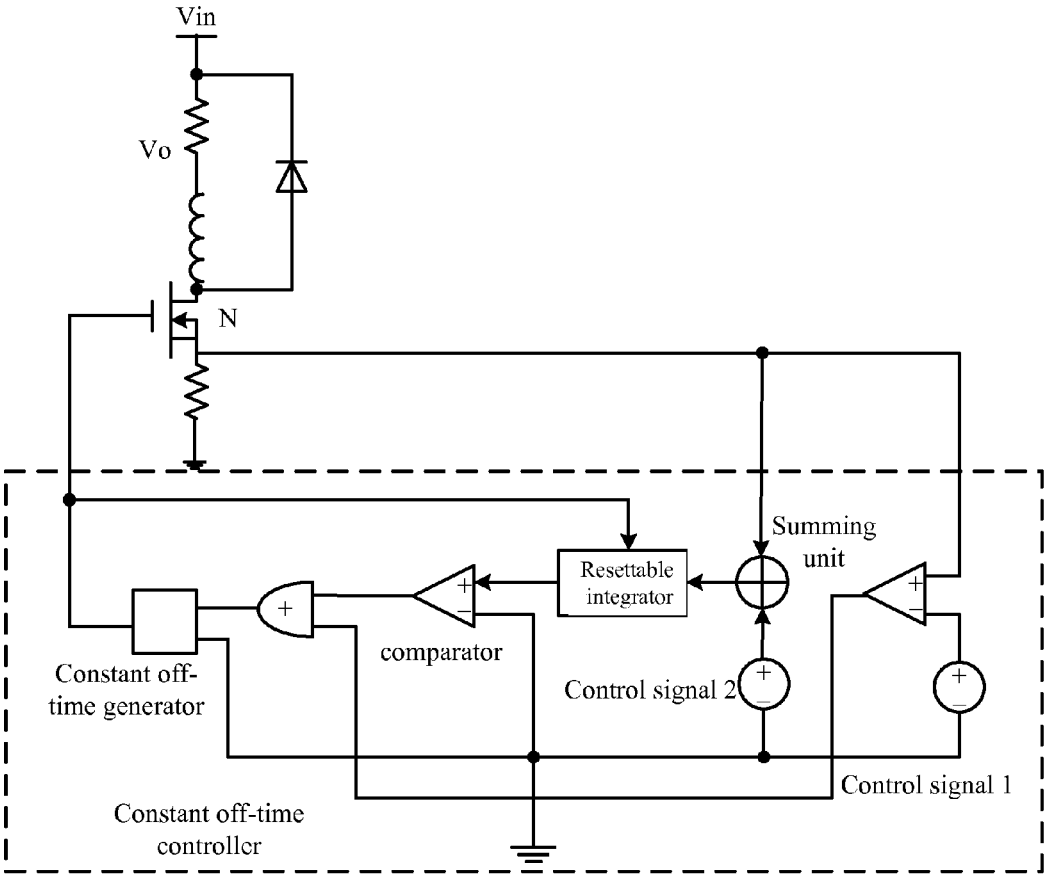
FIG. 3 (conventional)

POWER REGULATOR AND CONTROLLING METHOD THEREOF

RELATED APPLICATIONS

This application is a continuation of the following application, U.S. patent application Ser. No. 12/932,183, entitled "POWER REGULATOR AND CONTROLLING METHOD THEREOF," filed on Feb. 18, 2011, now issued as U.S. Pat. No. 8,384,362, and which is hereby incorporated by reference as if it is set forth in full in this specification, and which also claims the benefit of Chinese Patent Application No. CN201010116178.4, filed on Mar. 2, 2010, which is incorporated herein by reference in its entirety.

FIELD OF THE INVENTION

The present invention generally relates to the field of power regulating devices. More specifically, embodiments of the present invention pertain to a power regulator with a pseudo constant frequency.

BACKGROUND

Conventional control schemes for power regulation may be implemented by controlling an on and off time of switching devices in order to achieve regulation for output voltage or current. Two example control schemes for switching devices are common. One is a pulse width modulation (PWM) control scheme, and another is a constant time control scheme that may utilize constant off-time or on-time control schemes.

However, when constant on-time is employed, the on-time of the switching device may be fixed while the switching frequency is variable. This can lead to disadvantages, such as poor stability, additional filter and interference suppression, increased design complexity, and higher costs.

SUMMARY

Embodiments of the present invention relate to methods of operating, as well as circuits, structures, devices, and/or applications for power regulation with a pseudo constant frequency that uses a constant time control scheme.

In one embodiment, a power regulator for converting an input electrical signal to an output electrical signal to supply power to a load, can include: (i) a power stage having switching devices and a filter; (ii) a regulation signal generator for the switching devices, where the regulation signal generator includes a feedback circuit and a pulse width modulator (PWM), the feedback circuit receiving an output signal from the power stage, the PWM receiving an output from the feedback circuit, and generating a PWM control signal; (iii) a constant time generator receiving the PWM control signal and generating a constant time signal based on a duty cycle of the PWM control signal; and (iv) a logic/driving circuit receiving the PWM control signal and the constant time signal, and controlling operation of the switching devices to modulate the output signal from the power stage, and maintaining a pseudo constant operation frequency.

In another embodiment, a method of controlling regulation of an output of a power regulator, can include: (i) sampling the output of the power regulator using a feedback circuit; (ii) receiving an output from the feedback circuit using a PWM, and generating a PWM control signal; (iii) generating a constant time signal using a constant time generator based on a duty cycle of the PWM control signal; and (iv) receiving the PWM control signal and the constant time signal using a logic/driving circuit, and in response, controlling operation of switching devices of a power stage to regulate the output of the power regulator to maintain a pseudo constant operation frequency for the switching devices.

Embodiments of the present invention can advantageously provide a solution for power regulation with a pseudo constant frequency that uses a constant time control scheme. Advantages include increased stability, as well as reduced design complexity, and lower associated costs. Other advantages of the present invention will become readily apparent from the detailed description of preferred embodiments below.

BRIEF DESCRIPTION OF THE DRAWINGS

FIG. 1A is a block diagram showing an example PWM control scheme with constant frequency.

FIG. 1B is an example operation waveform of the PWM control scheme shown in FIG. 1A.

FIG. 2A is a schematic diagram showing an example constant off-time control scheme.

FIG. 2B is an example operation waveform of the constant off-time control scheme shown in FIG. 2A.

FIG. 3 is a schematic diagram showing an example power regulator with constant frequency.

DETAILED DESCRIPTION

Figure 4:
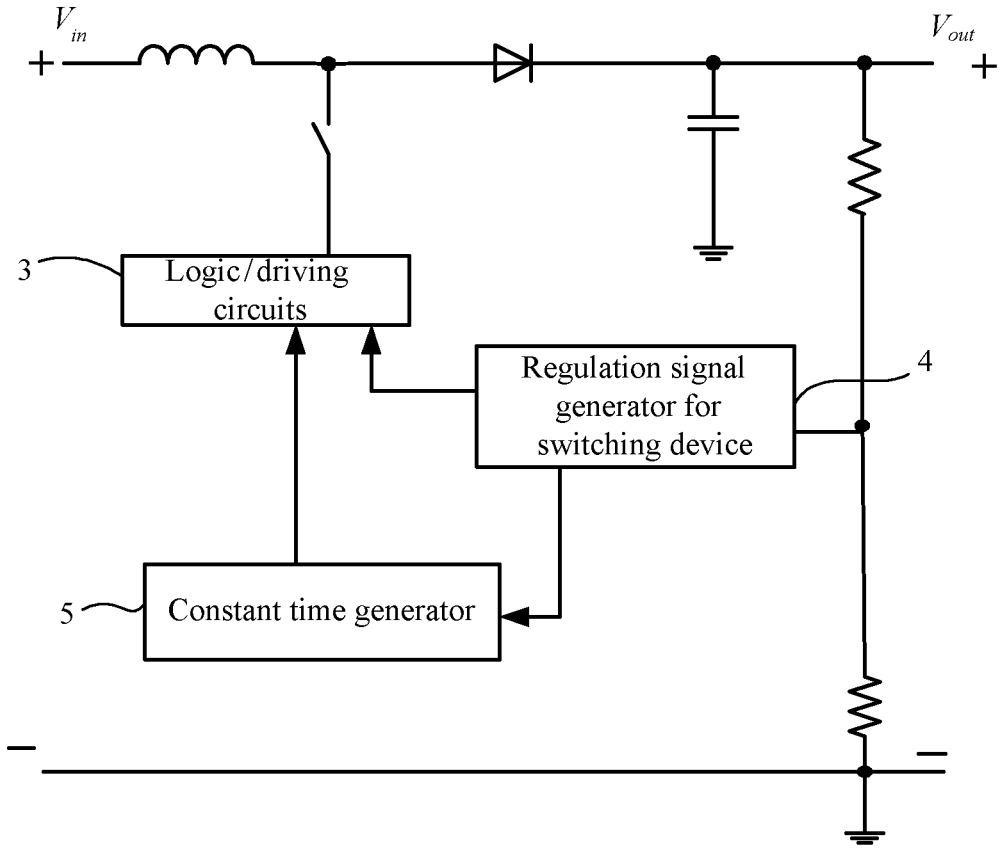
FIG. 4 is a block diagram showing an example power regulator in accordance with embodiments of the present invention.

Reference will now be made in detail to particular embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it will be readily apparent to one skilled in the art that the present invention may be practiced without these specific details. In other instances, well-known methods, procedures, processes, components, structures, and circuits have not been described in detail so as not to unnecessarily obscure aspects of the present invention.

Some portions of the detailed descriptions which follow are presented in terms of processes, procedures, logic blocks, functional blocks, processing, schematic symbols, and/or other symbolic representations of operations on data streams, signals, or waveforms within a computer, processor, controller, device and/or memory. These descriptions and representations are generally used by those skilled in the data processing arts to effectively convey the substance of their work to others skilled in the art. Usually, though not necessarily, quantities being manipulated take the form of electrical, magnetic, optical, or quantum signals capable of being stored, transferred, combined, compared, and otherwise manipulated in a computer or data processing system. It has proven convenient at times, principally for reasons of common usage, to refer to these signals as bits, waves, waveforms, streams, values, elements, symbols, characters, terms, numbers, or the like.

Furthermore, in the context of this application, the terms "wire," "wiring," "line," "signal," "conductor," and "bus" refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Embodiments of the present invention can advantageously provide a solution for power regulation with a pseudo constant frequency that uses a constant time control scheme. Advantages include increased stability, as well as reduced design complexity, and lower associated costs. The invention, in its various aspects, will be explained in greater detail below with regard to exemplary embodiments.

An example of pulse width modulation or modulator (PWM) control scheme with constant frequency is illustrated in FIG. 1A, with a corresponding operation waveform shown in FIG. 1B. As shown in these figures, the constant frequency PWM control can be operated as follows: the switching device can be turned on in response to an internal clock, and the off signal generated by PWM circuit 2 and logic/driving circuits 1 can turn off the switching device within a remaining portion of the present clock cycle until a next trailing edge of next clock. In certain embodiments, the off signal can be obtained by comparing sensing inductor current with a reference signal to control the off state of the switching device. The operation frequency of the switching devices can be fixed because of the control of internal clock cycle. However, drawbacks of this approach include sub-harmonic oscillation being unavoidable. Also, slope compensation should be added, and the transient response speed may be relatively slow.

An example of another power regulator with constant off-time scheme and corresponding operational waveforms are illustrated in FIGS. 2A and 2B respectively. As can be seen, both constant off-time circuit 5 and PWM control circuit 7 may be connected to logic/driving circuit 1 to control operation of the switching device. When the switching device is turned off by the combination of feedback circuit 6 and PWM control circuit 7, the off state of the switching device may be held for a fixed time that constant time circuit 5 produces. As compared to the control scheme of FIG. 1A, sub-harmonic oscillation may not exist without harmful influence, while improved dynamitic response and constant critical current can be achieved. However, the constant off-time scheme can result in a variable switching frequency. With this restriction, the design of an electromagnetic interference (EMI) filter is more difficult in view of the range of variable frequency, and also the stability of the entire topology is more difficult to respond to such unpredictable interference with other internal circuits.

In view of the above-mentioned difficulty caused by the variable switching frequency, improved control schemes with constant off-time and switching frequency have been developed (e.g., Chinese patent publication CN200710068436.4). One such example schematic diagram is shown in FIG. 3. When the power switch turns on, the current flowing through the inductor and sensing resistor increases. The sensing voltage of the sensing resistor and a predetermined control signal may be compared in a summing unit, and the result can be transferred or sent to a resettable integrator, which can be reset. With the increase of inductor current, the output of the integrator can change from zero to a negative level, and then change from a negative level to zero. On the rising edge of the integrator, the comparator can trigger the constant off-time generator, the output of which can reset the integrator to turn off the power switch for the constant time $T_{OFF}$.

Both the input voltage and output voltage together may determine the switching frequency, and the constant off-time can be calculated as the following formula: $T_{OFF}=K*(V_{IN}-V_{OUT})/V_{IN}$. To carry out the scheme in the example of FIG. 3, the samplers for both input voltage and output voltage, and integrator, should be necessary, thus increasing complexity. For certain applications of integrated circuits without output pins, a dedicated output pin and associated circuits may be added, resulting in increased circuit complexity. Further, when constant on-time is employed, the on-time of the switching device may be fixed while the switching frequency is variable, also possibly leading to the same disadvantages, such as poor stability, addition of an effective filter and interference suppressor, overall complicated design and higher associated costs.

In particular embodiments, a power regulator and associated methodology can address and overcome the relatively complicated design of filter and compensation of a sub-harmonic oscillator. In one aspect, a power stage, regulation signal generator of the switching devices, constant time generator and logic/driving circuit are included. Switching devices and a filter may be included with the power stage. A feedback circuit can be used to receive an output of the power stage and pulse width modulation (PWM) circuit to receive the output of the feedback circuit to produce the PWM control signal from the regulation signal generator of the switching devices. The constant time generator can generate a constant time signal based on the received PWM control signal. Both the PWM control signal and the constant time signal can be sent to the logic/driving circuit to control operation of the switching devices for regulation of the output, and a constant operation frequency of the switching devices.

The constant time generator can also include: a reference voltage generator to receive the internal PWM control signal and produce a reference voltage; a ramp signal generator to receive the internal PWM control signal and produce a ramp signal with fixed slope; and a comparator to compare the reference voltage with the ramp signal to produce the constant time signal that is output to the logic/driving circuit.

Furthermore, the reference voltage generator can include an averaging circuit to average the received PWM control signal and a source voltage to produce a reference voltage that is in direct proportion with the off-duty cycle of PWM control signal, and then be fed to the comparator.

In addition, the reference voltage generator can include an averaging circuit to average the received PWM control signal and a source voltage to produce a reference voltage that is proportional to the on-duty cycle of PWM control signal, and then be fed to the comparator.

The ramp signal generator can also include a first constant-current source and a first capacitor that are employed to receive the PWM control signal and produce a ramp signal with fixed slope, the peak value of which is treated as a reference voltage of the reference voltage generator. The averaging circuit can also include a first resistor and second capacitor to average the received PWM control signal and source voltage.

Another embodiment detailed herein describes a control method of output regulation for a power regulator. The example control method can include: sampling the output signal using a feedback circuit; generating a PWM control signal using a PWM circuit based on the received output of feedback circuit; generating a constant time signal using a constant time generator; receiving the PWM control signal and the constant time signal using a logic/driving circuit to control the operation of switching devices of the power stage; and regulating the output signal to maintain a pseudo constant operation frequency for switching devices.

The example control method of output regulation for a power regulator may further include: producing a reference voltage proportional to the off-duty cycle of the PWM control signal using a reference voltage generator; generating a ramp signal with a fixed slope through a ramp signal generator; comparing the reference voltage and ramp signal to produce a constant time signal; and controlling the off time of switching devices according to both the constant time signal and the PWM control signal using the logic/driving circuit to maintain a pseudo constant operation frequency for the switching devices.

The example control method of output regulation for a power regulator may further include: producing a reference voltage proportional to the on-duty cycle of PWM control signal using a reference voltage generator; generating a ramp signal with a fixed slope through a ramp signal generator; comparing the reference voltage and ramp signal to produce a constant time signal; controlling the on time of switching devices according to both the constant time signal and the PWM control signal using the logic/driving circuit to maintain a pseudo constant operation frequency for the switching devices.

With certain embodiments, both the constant off or on time of the switching devices and the pseudo constant operation frequency can be achieved. Advantages of certain embodiments include simplified design of an associated EMI filter, lower costs, less interference to other circuits, and stronger stability for the entire power regulator.

Additional aspects and advantages of particular embodiments will become readily apparent to those skilled in the art from the detailed description herein, where only exemplary embodiments are shown and described. As will be realized, the present invention is capable of other and different embodiments, and its several details are capable of modifications in various respects, all without departing from the invention. Accordingly, the drawings and description are to be regarded as illustrative in nature, and not as restrictive.

Figure 5:
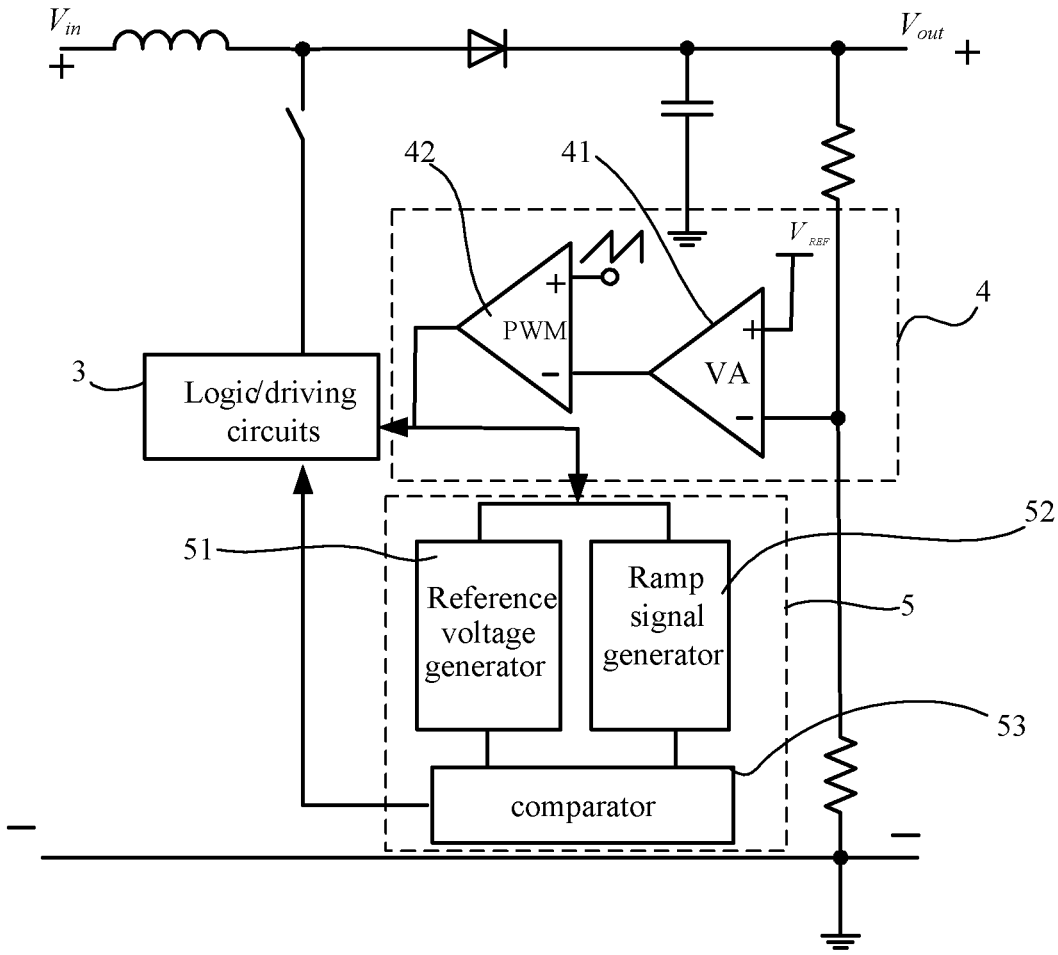
FIG. 5 is a schematic diagram showing an example of a power regulator in accordance with embodiments of the present invention.

Referring now to FIGS. 4 and 5, shown are schematic diagrams of an example power regulator in accordance with embodiments of the present invention. The power regulator in FIG. 4 can include the power stage, regulation signal generator for switching device 4, constant time generator 5, and logic/driving circuit 3.

Any suitable type of regulator topology, such as step-up, step-down, step-up/step-down, flyback, forward topology, etc., of converter, including switching devices and filters, can be employed as the power stage in particular embodiments.

Referring now to FIG. 5, regulation signal generator for the switching device 4 can further include feedback circuit (VA) 41 to receive the output signal of the power stage and PWM circuits 42 to generate a PWM control signal based on the output signal that has been received.

Constant time generator 5 can be used to receive the PWM control signal, and then to produce a constant time signal that is proportional to the duty cycle of PWM control signal.

Logic/driving circuit 3 may be used to control operation of the switching device in the power stage based on the received PWM control signal and constant time signal for regulation of the output signal and achievement of a pseudo constant operation frequency for the switching device.

Constant time generator 5 may further include a reference voltage generator 51 to generate a reference voltage, a ramp signal generator 52 to generate a ramp signal with a substantially fixed slope, and a comparator 53 to compare the reference voltage with the ramp signal to produce a constant time signal that is then transferred or otherwise sent to the logic/driving circuit 3.

Logic/driving circuit 3 may be used to control the on-time or off-time of the switching device in the power stage in order to maintain a pseudo constant operation frequency for the switching device.

Logic/driving circuits 3, power stage, and regulation signal generator for switching devices, can be implemented using techniques known in the art, and as such are not described in great detail herein. With reference to the drawings, the examples of constant time generators are further illustrated and described.

Figure 6A:
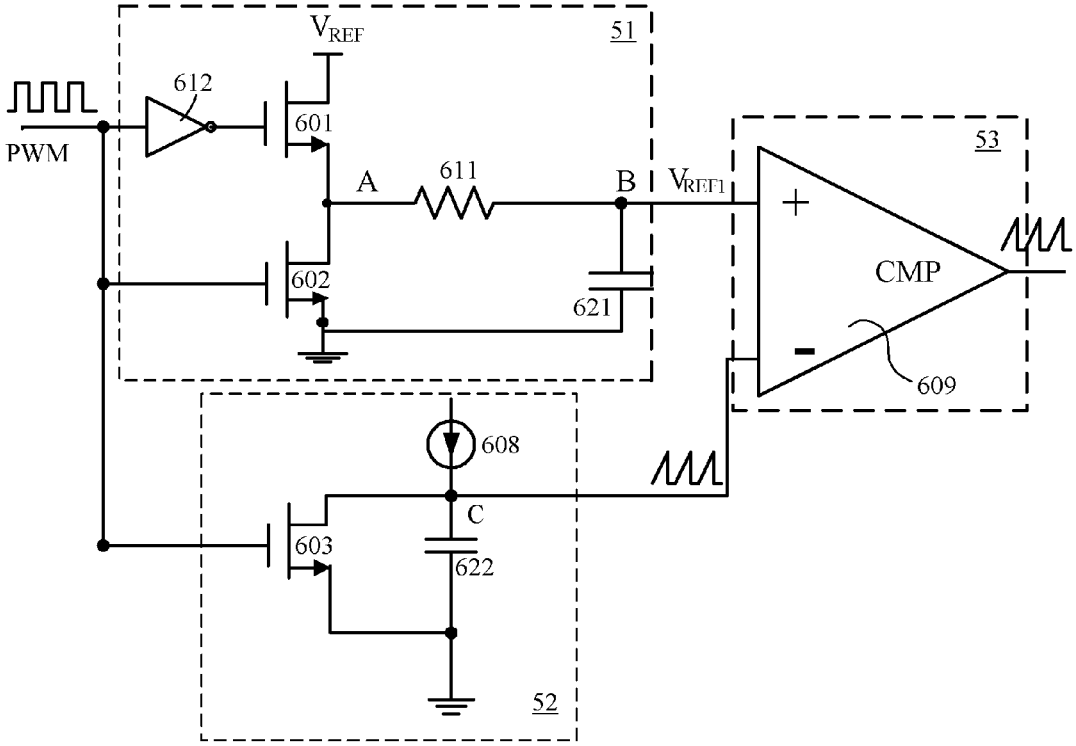
FIG. 6A is a schematic diagram showing a first example constant time generator in accordance with embodiments of the present invention.
Figure 6B:
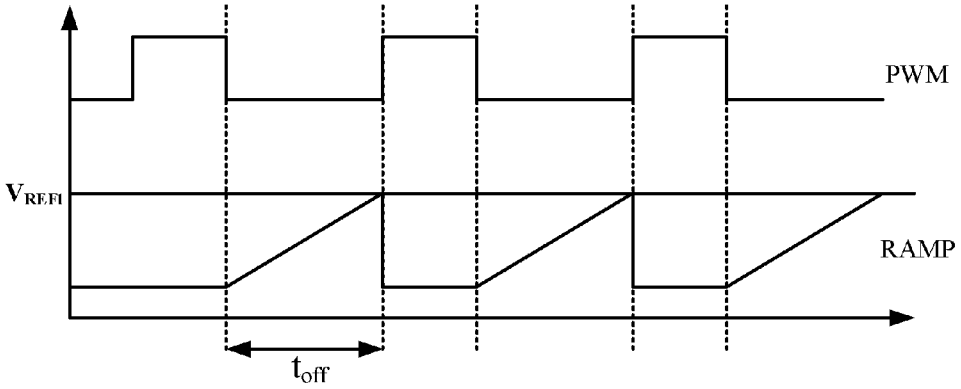
FIG. 6B is an example waveform of the constant time generator shown in FIG. 6A.
Figure 7A:
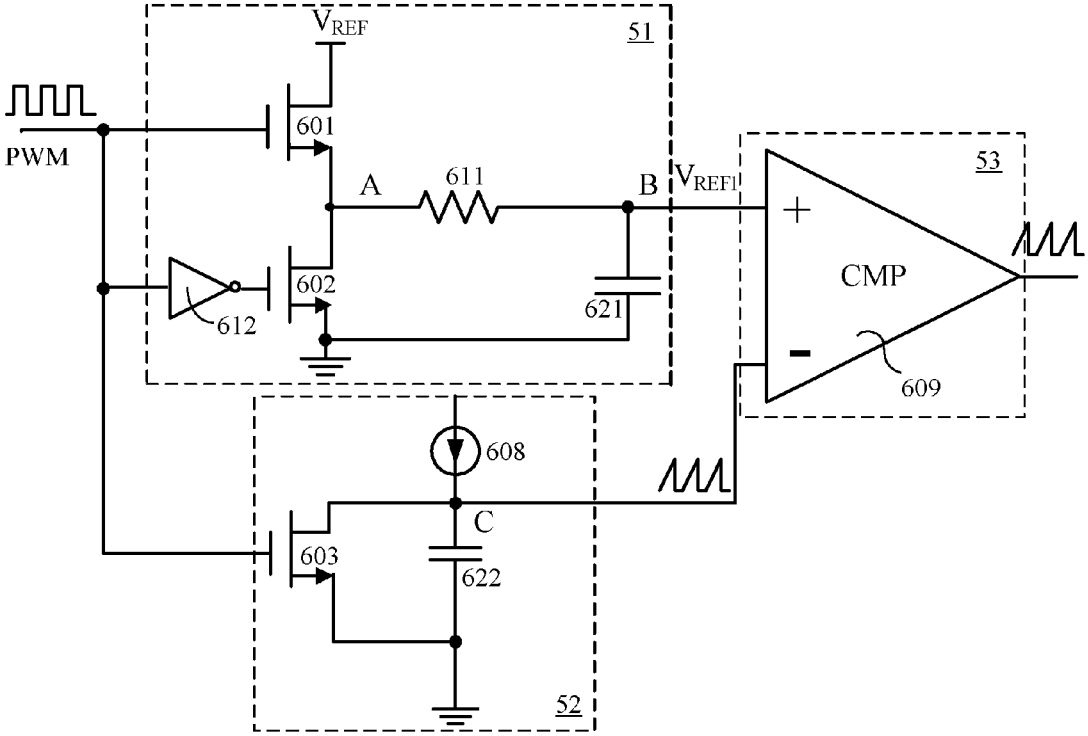
FIG. 7A is a schematic diagram showing a second example constant time generator in accordance with embodiments of the present invention.
Figure 7B:
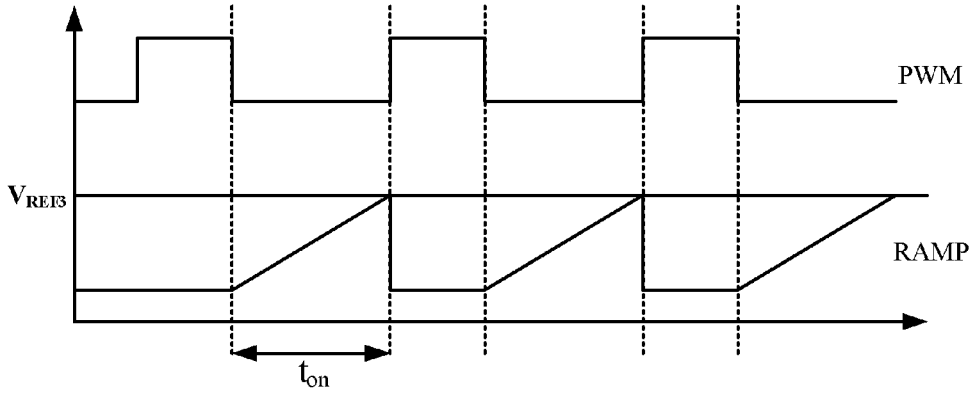
FIG. 7B is an example waveform of the constant time generator shown in FIG. 7A.

FIGS. 6A and 7A show constant time generator examples in accordance with embodiments of the present invention. FIGS. 6B and 7B show corresponding operational waveform examples for FIGS. 6A and 7A, respectively.

Referring now to FIG. 6A, shown is a schematic diagram of the constant time generator 5 in accordance with embodiments of the present invention, with operation waveform examples shown in FIG. 6B. Constant time generator 5 can include reference voltage generator 51, ramp signal generator 52 and comparator 53. The reference voltage generator can include a switching circuit to receive the PWM control signal and a reference source, and an averaging circuit to average the received PWM control signal.

Comparator 53 can include comparator (CMP) 609 as shown. For example, inverter 612, first transistor 601 and second transistor 602 may form the switching circuit, while resistor 611 and first capacitor 621 form the averaging circuit.

Connected in series between input terminal $V_{REF}$ and ground may be first transistor 601 and the second transistor 602, where the common junction node of both transistors is shown as node A. The drain of first transistor 601 may be connected to receive source or reference voltage $V_{REF}$, the source of which can be connected to common node A. An internal PWM control signal may be coupled to the gate of first transistor 601 through inverter 612, and the gate of the second transistor 602 directly. Second transistor 602 can be connected with its drain connected to the common node A and source connected to ground.

Common node A may be connected to one terminal of resistor 611 as one input of the averaging circuit including resistor 611 and capacitor 621 connected in series between common node A and ground. The common junction node of resistor 611 and capacitor 621 is indicated as node B, which may be input to the non-inverting terminal of comparator 609.

Ramp signal generator 52 can include constant-current source 608, second capacitor 622 and third transistor 603. The gate of third transistor 603 can be connected to receive the internal PWM control signal, and the source of third transistor 603 may be connected to ground. The junction node of the drain, constant-current source 608 and second capacitor 622 is indicated as node C, which is input into the inverting terminal of comparator 609. Second capacitor 622 may be connected in parallel with third transistor 603 as shown.

If the on-duty cycle of the internal PWM control signal is indicated as D, the operation frequency $f_{sw}$ of the switching device can be calculated as in the following formula (1):

$$f_{sw} = \frac{1}{T} = \frac{1-D}{t_{off}} \tag{1}$$

In formula (1), 1−D may represent the off-duty cycle of internal PWM control signal, T may represent the operation period of the switching device, and $t_{off}$ may represent the off time of switching device.

If the off time $t_{off}$ can be made proportional to the off-duty cycle (1−D), as shown in the following formula (2), based on the teaching of formula (1), $$t_{off}=k(1-D) \tag{2}$$

In formula (2), k may represent a constant value, and the formula (1) can be converted as follows in (3):

$$f_{sw} = \frac{1}{T} = \frac{1-D}{t_{off}} = \frac{1-D}{K(1-D)} = \frac{1}{K} \tag{3}$$

Thus, the frequency $f_{sw}$ may be set to be a constant value in order to maintain the operation frequency pseudo constant for the switching device.

In certain embodiments, a time signal in direct proportion with the off-duty cycle (1−D) of the internal PWM control signal that may be used to control the off time of the switching device $t_{off}$ can be produced through a constant time generator.

A regulation signal for the switching device may be obtained through a logic calculation of the constant time signal and the PWM control signal to control the off operation of the switching device in order to regulate output signal of the power regulator.

In operation of particular embodiments, the source or reference voltage $V_{REF}$ can be modulated by the PWM control signal through the switching circuit that includes inverter 612, first transistor 601, and second transistor 602, and may then be filtered by the averaging circuit that includes resistor 611 and first capacitor 621. A reference voltage $V_{REF1}$ having a value of approximately $(1-D)\times V_{REF}$ can be generated at common node B of resistor 611 and first capacitor 621 for sending to comparator 609, where D represents the on-duty cycle of the PWM control signal.

During a switching cycle, when the PWM control signal goes high, the third transistor 603 turns on, and a voltage of a second capacitor 622 may have the value of about zero. When the PWM control signal goes low, third transistor 603 turns off, constant-current source 608 can begin to charge second capacitor 622 until the PWM control signal goes high again in the next cycle.

Because of comparator 609, the peak voltage of second capacitor 622 at node C can be the reference voltage $V_{REF1}$ during the charging internal or the off time of the PWM control signal, which may be produced by the reference voltage generator with a value of $(1-D)\times V_{REF}$, and can also be referenced to the voltage at the inverting terminal of the comparator 609. Cycle by cycle, the voltage at the common node C will be a ramp signal with fixed percentage of slope and constant peak value, $V_{REF1}$.

Assuming the value of a third capacitor (not shown) is $C_0$ and the current amplitude of the constant-current source 608 is $I_0$, the rising time of the ramp signal with fixed slope can be calculated to be $$\frac{V_{REF1}}{I_0/C_0},$$

which is used to control the off time of the switching device, as shown below in formula (4).

$$\begin{aligned} t_{off} &= \frac{V_{REF1}}{I_0/C_0} \\ &= \frac{(1-D)\times V_{REF}}{I_0/C_0} \\ &= \frac{V_{REF}\times C_0}{I_0}\times(1-D) \\ &= k\times(1-D) \end{aligned} \tag{4}$$

In this way, an off-time proportional to the off-duty cycle (1−D) is achieved, with the proportion coefficient as shown below in formula (5).

$$k = \frac{V_{REF}\times C_0}{I_0} \tag{5}$$

The frequency of the switching device can be calculated as follows below in formula (6).

$$f_{sw} = \frac{1-D}{t_{off}} = \frac{I_0}{V_{REF}\times C_0} \tag{6}$$

Thus, both the off time and the operation frequency may be substantially fixed in a constant value.

In an example of a step-up power regulator that uses the constant time generator as described above, the operation can be implemented as follows. In every switching cycle, when the sensed inductor current reaches a predetermined value, the logic/driving circuit may turn the switching device off, and the off state can be held as such for the constant off time controlled by the constant time generator. After that, the switching device may be turned on again. Cycle by cycle, the output of the power regulator is thus regulated in a pseudo constant frequency.

Referring now to FIG. 7A, shown is a schematic diagram of a second example constant time generator 5 in accordance with embodiments of the present invention. FIG. 7B shows corresponding example operational waveforms for the generator of FIG. 7A.

Constant time generator 5 can include reference voltage generator 51, ramp signal generator 52, and comparator module 53. The reference voltage generator can include the switching circuit to receive the PWM control signal and a reference source, and the averaging circuit to average the received PWM control signal.

The comparator module 53 may include comparator 609. Inverter 612, first transistor 601, and second transistor 602 can form the switching circuit, while resistor 611 and first capacitor 621 may form the averaging circuit.

Connected in series between terminal $V_{REF}$ and ground can be first transistor 601 and second transistor 602, where the common junction node of both transistors is identified as node A. The drain of first transistor 601 maybe connected to receive the source reference voltage $V_{REF}$, and the source of first transistor 601 can be connected to common node A. An internal PWM control signal can be coupled to the gate of second transistor 602 through inverter 612, and the gate of the first transistor 601 directly. Second transistor 602 may be connected with its drain connected to common node A, and the source connected to ground.

Common node A may be connected to one terminal of resistor 611 as one input of the averaging circuit that is formed by resistor 611 and capacitor 621 connected in series between common node A and ground. The common junction node of resistor 611 and capacitor 621 is indicated as node B, which may be provided to the non-inverting terminal of comparator 609.

Ramp signal generator 52 can include constant-current source 608, second capacitor 622, and third transistor 603. The gate of third transistor 603 may be connected to receive the internal PWM control signal, and the source of third transistor 603 can be connected to ground. The junction node of the drain, constant-current source 608, and the second capacitor 622 is designated as node C, which is input into the inverting-terminal of comparator 609. Second capacitor 622 is may be connected in parallel with the third transistor 603.

Assuming the on-duty cycle of the internal PWM control signal is indicated as D, the operation frequency $f_{sw}$ of the switching device can be calculated as shown in following formula (7):

$$f_{sw} = \frac{1}{T} = \frac{D}{t_{on}} \tag{7}$$

In this example, D represents the on-duty cycle of the internal PWM control signal, T represents the operation period of the switching device, and $t_{on}$ represents the on time of switching device.

The on time $t_{on}$ may be proportional to the on-duty cycle D, as shown in the following formula (8), based on the teaching of formula (1).

$$D = k \times t_{on} \tag{8}$$

In this example, k represents a constant value, and the formula (7) can be converted as follows in formula (9).

$$f_{sw} = \frac{1}{T} = \frac{D}{t_{on}} = \frac{k \times t_{on}}{t_{on}} = k \tag{9}$$

In this example, the frequency $f_{sw}$ may be set to be a constant value in order to maintain the operation frequency pseudo constant for the switching device.

In particular embodiments, a time signal in direct proportion with the on-duty cycle D of the internal PWM control signal that is used to control the on time of the switching device $t_{on}$ is produced through a constant time generator.

A regulation signal for the switching device may be obtained through a logic calculation of the constant time signal and PWM control signal to control the on operation of the switching device in order to regulate output signal of the power regulator.

In example operation, reference source $V_{REF}$ may be modulated by the PWM control signal through the switching circuit that is formed by inverter 612, first transistor 601, and second transistor 602, and then filtered by the averaging circuit that is formed by resistor 611 and first capacitor 621. A reference voltage $V_{REF1}$ with an approximate value of $D \times V_{REF}$ may be generated at the common node B of resistor 611 and first capacitor 621 to be transferred or sent to comparator 609, where D represents the on-duty cycle of the PWM control signal.

During a switching cycle, when the PWM control signal goes high, third transistor 603 turns on, and the voltage of second capacitor 622 has a value of about zero. When the PWM control signal goes low, third transistor 603 turns off, constant-current source 608 may begin to charge second capacitor 622 until the start of the next cycle when the PWM control signal goes high again.

Because of comparator 609, the peak voltage of second capacitor 622 at the node C may be the reference voltage $V_{REF1}$ during the charging internal or the on time of the PWM control signal, which is produced by the reference voltage generator with the value of $D \times V_{REF}$, and which can also be referred to the voltage at the inverting terminal of the comparator 609. Cycle by cycle, the voltage at the common node C may be a ramp signal with fixed slope and constant peak value $V_{REF1}$.

If the value of the third capacitor is $C_1$ and the amplitude of the constant-current source 608 is $I_1$, the rising time of the ramp signal with fixed percentage of slope can be calculated to be $$\frac{V_{REF1}}{I_1 / C_1},$$

which is used to control the on time $t_{on}$ of the switching device, as shown below in formula (10).

$$\begin{aligned} t_{on} &= \frac{V_{REF1}}{I_1 / C_1} \\ &= \frac{D \times V_{REF}}{I_1 / C_1} \\ &= \frac{V_{REF} \times C_1}{I_1} \times D \\ &= k \times D \end{aligned} \tag{10}$$

Therefore, an on-time in proportion with the on-duty cycle D can be achieved, with the proportion coefficient as indicated below in formula (11).

$$k = \frac{V_{REF} \times C_1}{I_1} \tag{11}$$

The frequency of the switching device can be calculated as follows in formula (12).

$$f_{sw} = \frac{D}{t_{on}} = \frac{I_1}{V_{REF} \times C_1} \quad (12)$$

Both the on time and the operation frequency can thus be fixed in a constant value. In an example of a step-down power regulator using a constant time generator as described herein, the operation can be implemented as follows. In every switching cycle, when the sensed inductor current reaches a predetermined value, the logic/driving circuit turns the switching device on, and the on state will be held on for the constant on time that is controlled by the constant time generator. After that, the switching device will be turned off again. Cycle by cycle, the output of the power regulator is regulated in a pseudo constant frequency.

As will be realized by those skilled in the art, the present invention is capable of other and different embodiments, and its several details are capable of modifications in various respects, such as reference voltage generator and ramp signal generator, all without departing from the invention. For example, the transistors of the reference voltage generator 51 might be omitted in FIG. 6A and FIG. 7A. Also, a combination of a counter and a digital-to-analog converter (DAC) can replace the ramp signal generator 52 to realize a same or similar function.

Figure 8:
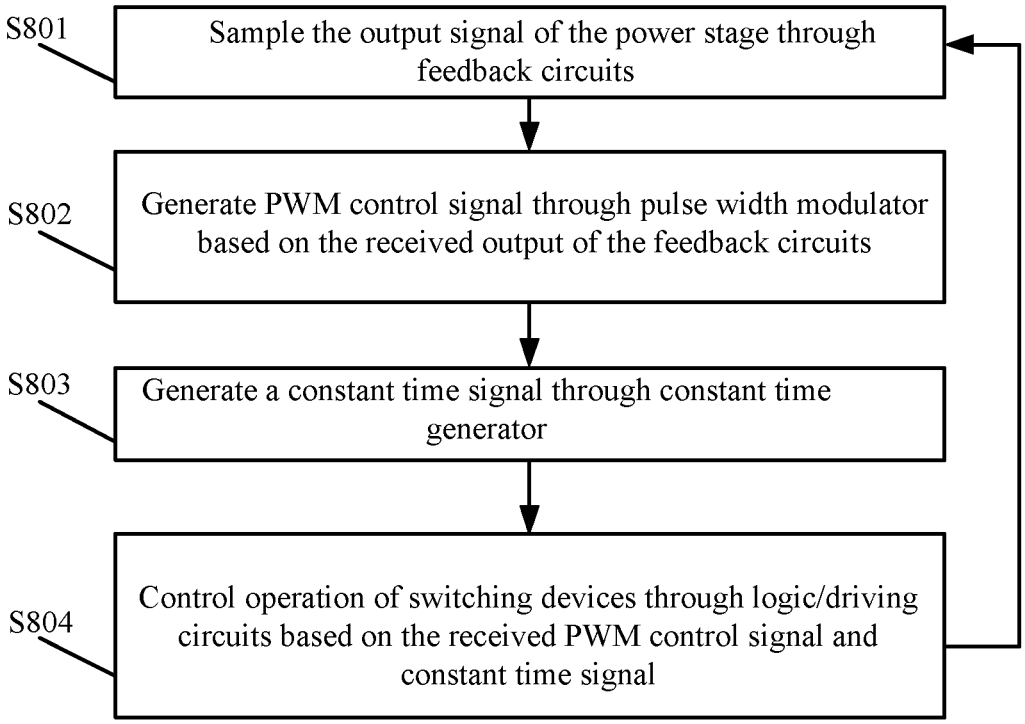
FIG. 8 is a flow diagram showing an example output regulation method for a power regulator in accordance with embodiments of the present invention.

Various example regulation control methods in accordance with embodiments will now be described. Referring to FIG. 8, shown is a flow diagram of an example output regulation method in accordance with embodiments of the present invention. In S801, the output signal of a power stage can be sampled through one or more feedback circuits. In S802, the PWM control signal can be generated based on the received output of the feedback circuit using a PWM. In S803, a constant time signal proportional to the duty cycle of the PWM control signal may be generated using a constant time generator. In S804, the operation of the switching device may be controlled using a logic/driving circuit based on the received PWM control signal and constant time signal in order to regulate the output signal and maintain a pseudo constant frequency for the switching device.

Figure 9:
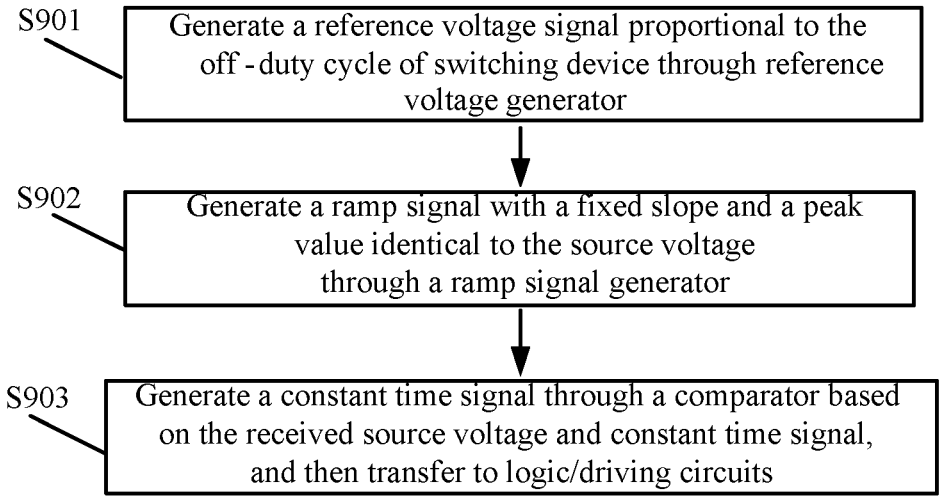
FIG. 9 is a flow diagram showing a first example generation method of a constant time in accordance with embodiments of the present invention.

Referring now to FIG. 9, shown is a flow diagram of a first example generation method of a constant time in accordance with embodiments of the present invention. In S901, a reference voltage proportional to an off-duty cycle of the PWM control signal can be generated using a reference voltage generator. In S902, a ramp signal with a fixed slope and a peak value identical to the reference voltage may be generated using a ramp signal generator. In S903, the reference voltage may be compared against the ramp signal to generate a constant time signal that is transferred or sent to the logic/driving circuit. The logic/driving circuit receives the PWM control signal and the constant time signal to control the operation of the switching device in order to realize a constant off time and a pseudo constant operation frequency for the switching device.

Figure 10:
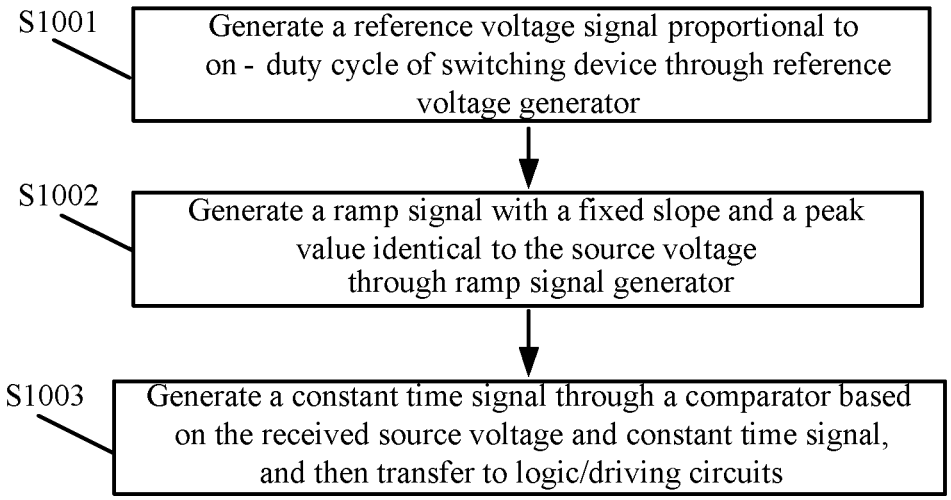
FIG. 10 is a flow diagram showing a second example generation method of a constant time in accordance with embodiments of the present invention.

Referring now to FIG. 10, shown is a flow diagram of a second example generation method of a constant time in accordance with embodiments of the present invention. In S1001, a reference voltage proportional to the on-duty cycle of the PWM control signal may be generated using a reference voltage generator. In S1002, a ramp signal with a fixed slope and a peak value identical to the reference voltage may be generated using a ramp signal generator. In S1003, the reference voltage can be compared against the ramp signal to generate a constant time signal to be transferred or sent to the logic/driving circuit. The logic/driving circuit may receive the PWM control signal and the constant time signal in order to control operation of the switching device to realize a constant on time and a pseudo constant operation frequency for the switching device.

Embodiments of the present invention can thus advantageously provide a power regulator with pseudo constant operation frequency. Further, various embodiments of the present invention can accommodate aspects of both simplified design and better stability of the complete circuits.

While the above examples include circuit and method implementations of power regulators, one skilled in the art will recognize that other technologies, methods of operation, and/or structures can be used in accordance with embodiments. Further, one skilled in the art will recognize that other device circuit arrangements, elements, and the like, may also be used in accordance with embodiments.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A power regulator for converting an input signal to an output signal to supply power to a load, said power regulator comprising:

a) a power stage having a switching device and a filter, wherein said power stage is configured to generate said output signal;

b) a regulation signal generator for said switching device, wherein said regulation signal generator is configured to receive feedback from said output signal, and to generate therefrom a pulse width modulation (PWM) control signal;

c) a constant time generator configured to receive said PWM control signal, and to generate a constant time signal based on a duty cycle of said PWM control signal; and d) a logic/driving circuit configured to receive said PWM control signal and said constant time signal, and to control operation of said switching device to modulate said output signal, and to maintain a pseudo constant operation frequency of said switching device.

2. The power regulator of claim 1, wherein said constant time generator further comprises:

a) a reference voltage generator configured to receive said PWM control signal, and to generate a first reference voltage;

b) a ramp signal generator configured to receive said PWM control signal, and to generate a ramp signal with a fixed slope; and c) a comparator configured to compare said first reference voltage with said ramp signal, and to generate said constant time signal, wherein said constant time signal is sent to said logic/driving circuit.

3. The power regulator of claim 2, wherein said reference voltage generator further comprises an averaging circuit configured to average said PWM control signal and said first reference voltage, and to generate a second reference voltage proportional to an off-duty cycle of said PWM control signal, wherein said second reference voltage is sent to said comparator.

4. The power regulator of claim 3, wherein said ramp signal generator further comprises a first constant-current source and a first capacitor to generate said ramp signal with said fixed slope based on said received PWM control signal, wherein a peak value of said ramp signal with said fixed slope is identical to said second reference voltage.

5. The power regulator of claim 2, wherein said reference voltage generator further comprises an averaging circuit configured to average said PWM control signal and said first reference voltage, and to generate a second reference voltage proportional to an on-duty cycle of said PWM control signal, wherein said second reference voltage is sent to said comparator.

6. The power regulator of claim 5, wherein said ramp signal generator further comprises a first constant-current source and a first capacitor to generate said ramp signal with said fixed slope based on said received PWM control signal, wherein a peak value of said ramp signal with said fixed slope is identical to said second reference voltage.

7. The power regulator of claim 2, wherein said ramp signal generator comprises a counter and a digital-to-analog converter (DAC).

8. The power regulator of claim 2, wherein said reference voltage generator further comprises a first resistor and a second capacitor configured to average said PWM control signal and said first reference voltage.

9. The power regulator of claim 2, wherein said reference voltage generator comprises:

a) a switching circuit configured to receive said PWM control signal; and b) an averaging circuit configured to average said PWM control signal.

10. The power regulator of claim 9, wherein:

a) said switching circuit comprises two transistors and an inverter; and b) said averaging circuit comprises a resistor and a capacitor.

11. The power regulator of claim 1, wherein said feedback is received from said output signal via a resistor coupled between a feedback circuit and said output signal.

12. The power regulator of claim 1, wherein said constant time signal is in direct proportion to an on-duty cycle of said PWM control signal.

13. The power regulator of claim 1, wherein said constant time signal is in direct proportion to an off-duty cycle of said PWM control signal.

14. An apparatus for controlling regulation of an output of a power regulator, the apparatus comprising:

a) means for sampling said output of said power regulator using a feedback circuit;

b) means for receiving an output from said feedback circuit using a pulse width modulation (PWM) circuit, and generating a PWM control signal therefrom;

c) means for generating a constant time signal using a constant time generator based on a duty cycle of said PWM control signal; and d) means for receiving said PWM control signal and said constant time signal using a logic/driving circuit, and in response, controlling operation of switching devices of a power stage to regulate said output of said power regulator to maintain a pseudo constant operation frequency for said switching devices.

15. The apparatus of claim 14, wherein said means for generating said constant time signal further comprises:

a) means for generating a reference voltage in direct proportion with an off-duty cycle of said PWM control signal using a reference voltage generator;

b) means for generating a ramp signal with a fixed slope using a ramp signal generator;

c) means for comparing said reference voltage and said ramp signal to generate a constant time signal using a comparator; and d) means for controlling operation of said switching devices with a logic/driving circuit based on said constant time signal and said PWM control signal to achieve a constant off-time and a pseudo constant operation frequency for said switching devices.

16. The apparatus of claim 14, wherein said means for generating said constant time signal further comprises:

a) means for generating a reference voltage in direct proportion with an on-duty cycle of said PWM control signal using a reference voltage generator;

b) means for generating a ramp signal with a fixed slope using a ramp signal generator;

c) means for comparing said reference voltage and said ramp signal using a comparator to generate a constant time signal; and d) means for controlling operation of switching devices with a logic/driving circuit based on said constant time signal and PWM control signal to achieve a constant on-time and a pseudo constant operation frequency for said switching devices.

* * * * *